US011052660B2

(12) United States Patent
Nakazawa et al.

(10) Patent No.: US 11,052,660 B2
(45) Date of Patent: Jul. 6, 2021

(54) LIQUID ABSORBER AND LIQUID EJECTION APPARATUS

(71) Applicant: SEIKO EPSON CORPORATION, Tokyo (JP)

(72) Inventors: Masahiko Nakazawa, Nagano (JP); Shogo Nakada, Nagano (JP); Yoichi Miyasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/752,782

(22) Filed: Jan. 27, 2020

(65) Prior Publication Data

US 2020/0238706 A1 Jul. 30, 2020

(30) Foreign Application Priority Data

Jan. 28, 2019 (JP) ..... JP2019-012452

(51) Int. Cl.
*B41J 2/17* (2006.01)
*B41J 2/165* (2006.01)

(52) U.S. Cl.
CPC ..... *B41J 2/16523* (2013.01); *B41J 2/1721* (2013.01)

(58) Field of Classification Search
CPC ..... B41J 2/16523; B41J 2/1721
See application file for complete search history.

(56) References Cited

U.S. PATENT DOCUMENTS

| | | | | |
|---|---|---|---|---|
| 8,096,636 | B2 | 1/2012 | Katoh | |
| 9,327,503 | B2 | 5/2016 | Higuchi | |
| 2008/0158294 | A1 | 7/2008 | Katoh | |
| 2014/0184692 | A1 | 7/2014 | Takano et al. | |
| 2014/0292913 | A1 | 10/2014 | Higuchi | |
| 2019/0299607 | A1 * | 10/2019 | Miyasaka | B41J 2/055 |

FOREIGN PATENT DOCUMENTS

| | | | |
|---|---|---|---|
| JP | 4999486 | B2 | 8/2012 |
| JP | 2014-188802 | A | 10/2014 |
| JP | 2016-168705 | A | 9/2016 |

* cited by examiner

*Primary Examiner* — Sharon Polk
(74) *Attorney, Agent, or Firm* — Global IP Counselors, LLP

(57) ABSTRACT

A liquid absorber includes a liquid absorption member and a case. The liquid absorption member absorbs liquid. The liquid absorption member includes materials that include a fiber and a liquid-absorbent resin. The liquid absorption member is stored in the case. The case has an opening portion. The materials of the liquid absorption member are bonded together in at least a portion of a surface of the liquid absorption member. The surface is a surface adjacent to the opening portion.

10 Claims, 14 Drawing Sheets

LIQUID ABSORBER AND LIQUID EJECTION APPARATUS

The present application is based on, and claims priority from JP Application Serial Number 2019-012452, filed Jan. 28, 2019, the disclosure of which is hereby incorporated by reference herein in its entirety.

BACKGROUND

1. Technical Field

The present disclosure relates to a liquid absorber and a liquid ejection apparatus.

2. Related Art

In ink jet printers, waste ink is typically generated during a head cleaning operation, which is performed to prevent a reduction in printing quality due to nozzle clogging caused by the drying of ink, and during an ink filling operation after a replacement of an ink cartridge. To absorb waste ink, a liquid absorber including a liquid absorption member is used.

For example, JP-A-2014-188802 describes a liquid absorption member that absorbs liquid. The liquid absorption member is formed primarily of a fiber and includes a fused resin.

Unfortunately, in the liquid absorption member of JP-A-2014-188802, the individual fibers are fused to one another with a fused resin, and, therefore, the liquid absorption member has a high bulk density. As such, the liquid absorption member has insufficient liquid absorption properties. In addition, the liquid absorption member needs to be processed to fit the shape of the case in which the liquid absorption member is to be stored, and, therefore, the liquid absorption member has low versatility and incurs high processing costs.

Correspondingly, the development of liquid absorption members that can conform to the shape of any desired case and can be provided at reduced processing costs is being advanced. Examples of such liquid absorption members include an assembly of crushed pieces and a fibrillated cotton fiber.

However, with a liquid absorption member that conforms to the shape of any desired case, it is difficult to ensure good absorption characteristics, because the crushed pieces and the fibrillated cotton fiber can become unevenly distributed during transfer, for example. In addition, for example, it is difficult to provide and maintain a shape of a recessed portion for preventing waste ink from spilling to the outside during the discharging of the waste ink, which may otherwise occur due to formation of bubbles.

SUMMARY

An embodiment of a liquid absorber according to the present disclosure includes a liquid absorption member and a case. The liquid absorption member absorbs liquid. The liquid absorption member includes materials that include a fiber and a liquid-absorbent resin. The liquid absorption member is stored in the case. The case has an opening portion. The materials of the liquid absorption member are bonded together in at least a portion of a surface of the liquid absorption member. The surface is a surface adjacent to the opening portion.

In another embodiment of the liquid absorber, the materials of the liquid absorption member may be bonded together in the at least a portion of the surface with a bonding force of a water-soluble resin.

In another embodiment of the liquid absorber, the materials of the liquid absorption member may be bonded to a sidewall portion of the case with the water-soluble resin.

In another embodiment of the liquid absorber, the materials of the liquid absorption member may be bonded together in the at least a portion of the surface with an adhesive force generated by swelling of the liquid-absorbent resin.

In another embodiment of the liquid absorber, the materials of the liquid absorption member may be bonded to a sidewall portion of the case with an adhesive force generated by swelling of the liquid-absorbent resin.

In another embodiment of the liquid absorber, the liquid absorption member may be bonded to at least one of a sidewall portion of the case and a bottom portion of the case, the sidewall portion not being exposed to the surface.

In another embodiment of the liquid absorber, the liquid absorption member may include a first recessed portion disposed in a location corresponding to the opening portion.

In another embodiment of the liquid absorber, the liquid absorption member may include an assembly of small pieces, and each of the small pieces may include a substrate and the liquid-absorbent resin, the substrate including the fiber, the liquid-absorbent resin being supported by the substrate.

In another embodiment of the liquid absorber, the liquid-absorbent resin may be held between a pair of portions of the substrate.

In another embodiment of the liquid absorber, the liquid absorption member may include a second recessed portion, and a porous liquid absorption member that absorbs the liquid may be disposed in the second recessed portion, a portion of the porous liquid absorption member projecting from the liquid absorption member.

An embodiment of a liquid ejection apparatus according to the present disclosure includes a liquid ejection head and the liquid absorber of any of the above embodiments. The liquid absorber is configured to absorb the liquid, the liquid being ejected from the liquid ejection head.

DESCRIPTION OF EXEMPLARY EMBODIMENTS

Preferred embodiments of the present disclosure will now be described in detail with reference to the drawings. Note that the embodiments described below are not intended to unduly limit the content of the present disclosure described in the claims. Furthermore, not all of the configurations described below may be essential configuration requirements of the present disclosure.

1. Liquid Absorber

Figure 1:
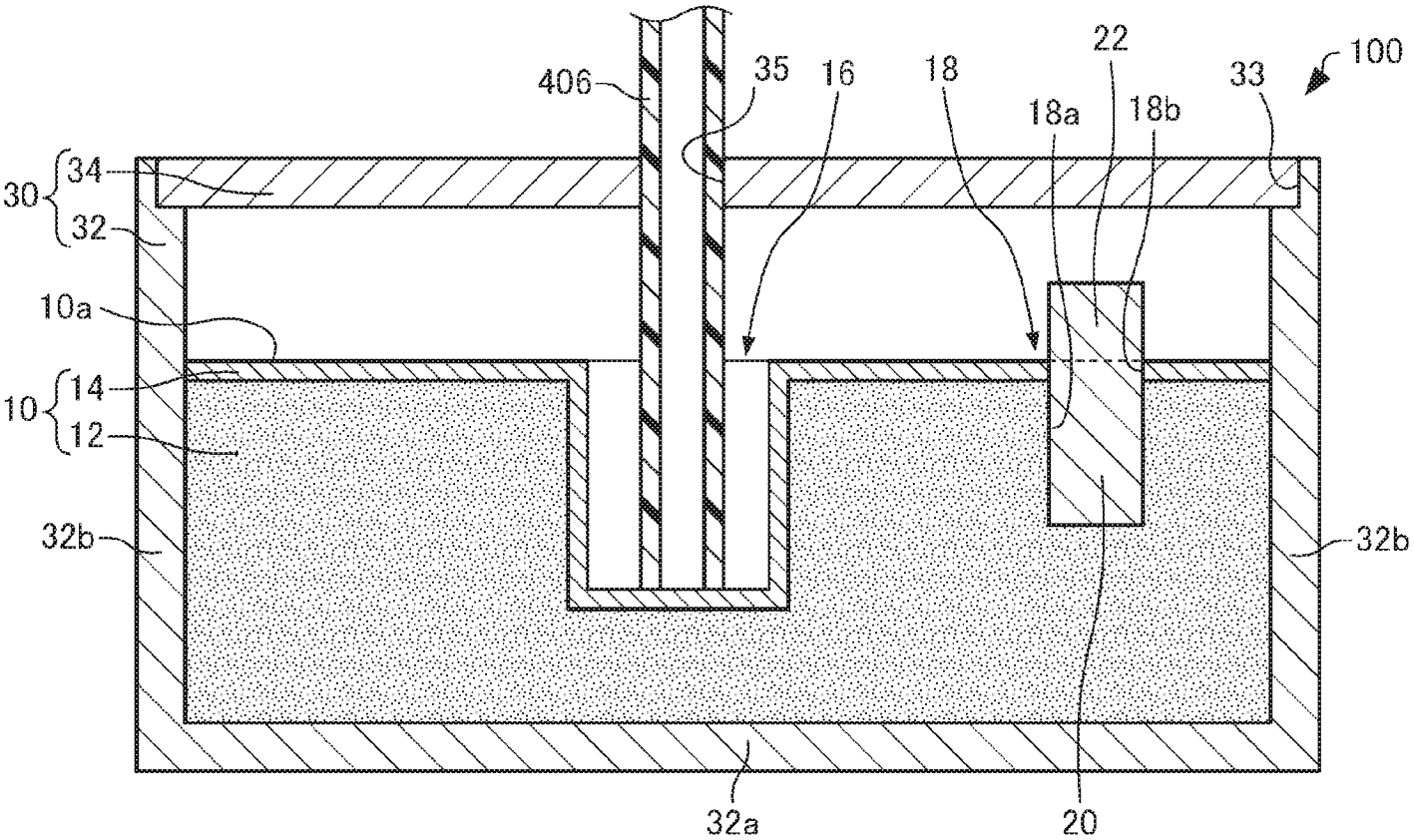
FIG. 1 is a schematic cross-sectional view of a liquid absorber, according to an embodiment.
Figure 2:
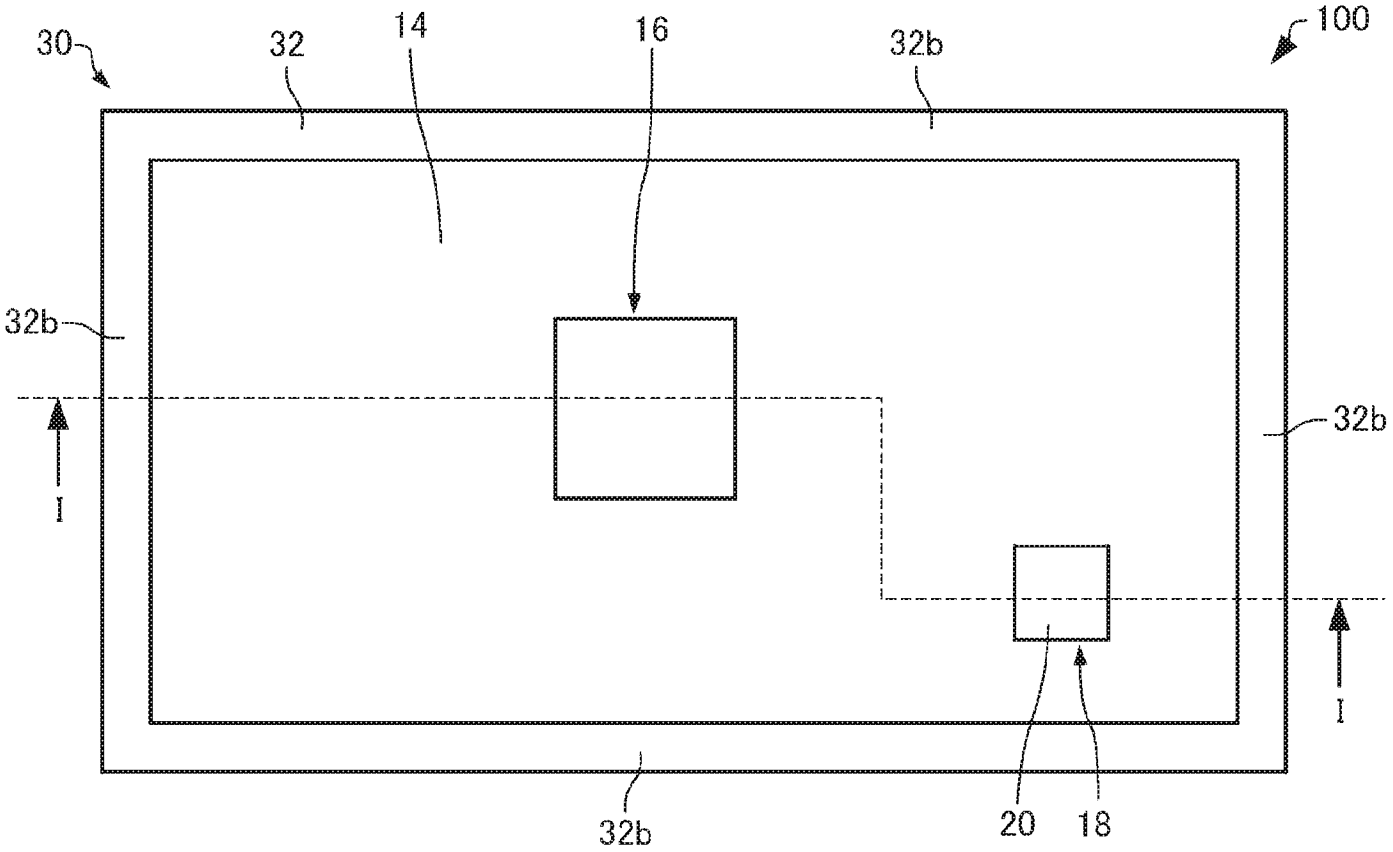
FIG. 2 is a schematic plan view of the liquid absorber, according to the embodiment.

First, a liquid absorber according to an embodiment will be described with reference to the drawings. FIG. 1 is a schematic cross-sectional view of a liquid absorber 100, according to an embodiment. FIG. 2 is a schematic plan view of the liquid absorber 100 according to the embodiment. Note that FIG. 1 is a cross-sectional view taken along line I-I of FIG. 2.

As illustrated in FIG. 1 and FIG. 2, the liquid absorber 100 includes a liquid absorption member 10, a porous liquid absorption member 20, and a case 30. Note that, in FIG. 1 and FIG. 2, the liquid absorption member 10 and the porous liquid absorption member 20 are illustrated in a simplified manner for convenience. Furthermore, a cover 34 of the case 30 and a tube 406 are omitted in FIG. 2.

As illustrated in FIG. 1, the liquid absorption member 10 includes an absorbing portion 12 and a bond layer 14, which is formed in an outermost surface (uppermost layer) of the absorbing portion 12. In the following description, each of the elements will be described.

1.1. Absorbing Portion

The absorbing portion 12 absorbs liquid. Specifically, the absorbing portion 12 absorbs inks, such as an aqueous ink in which a colorant is dissolved in an aqueous solvent, a solvent-based ink in which a binder is dissolved in a solvent, a UV (ultraviolet) curable ink in which a binder is dissolved in a liquid monomer that is cured by UV irradiation, and a latex ink in which a binder is dispersed in a dispersion medium. The following description is made assuming that the liquid absorbed by the absorbing portion 12 is ink.

The absorbing portion 12 includes individual fibers (substrates 5, each of which includes individual fibers) and liquid-absorbent resin particles. In the following description, the fiber and the liquid-absorbent resin included in the absorbing portion 12 will be described in the order mentioned.

1.1.1. Fiber

Examples of the fiber that is included in the absorbing portion 12 include synthetic resin fibers, such as polyester fibers and polyamide fibers, and natural resin fibers, such as cellulose fibers, keratinous fibers, and fibroin fibers.

It is preferable that the fiber that is included in the absorbing portion 12 be a cellulose fiber. Cellulose fibers are hydrophilic materials, and, therefore, when ink is provided to a cellulose fiber, the cellulose fiber can suitably take in the ink. In addition, the cellulose fiber can suitably deliver the ink that is taken temporarily to a liquid-absorbent resin. Hence, the absorbing portion 12 can have excellent absorption characteristics with respect to ink. Furthermore, cellulose fibers have a high affinity for liquid-absorbent resins and, therefore, can suitably support a liquid-absorbent resin on a surface of the fibers. Furthermore, cellulose fibers are renewable natural materials and are inexpensive and readily available compared with various other fibers. As such, cellulose fibers are advantageous also from the standpoint of reducing the production cost, ensuring stable production, and reducing environmental impact, for example.

Note that it is sufficient that the cellulose fiber be a fibrous material containing, as a major component, cellulose included in a compound, and the compound may include hemicellulose and/or lignin in addition to cellulose.

An average length of the individual fibers is preferably 0.1 mm or greater and 7 mm or less, more preferably 0.1 mm or greater and 5 mm or less, and even more preferably 0.1 mm or greater and 3 mm or less. An average width (diameter) of the individual fibers is preferably 0.5 μm or greater and 200 μm or less and more preferably 1.0 μm or greater and 100 μm or less. An average aspect ratio of the individual fibers is preferably 10 or greater and 1000 or less and more preferably 15 or greater and 500 or less. The average aspect ratio is the ratio of the average length to the average width.

When the above-mentioned ranges are satisfied, the fiber can support a liquid-absorbent resin, hold ink, and deliver the ink to the liquid-absorbent resin in a suitable manner, and, hence, the absorbing portion 12 has excellent absorption characteristics with respect to ink.

Figure 3:
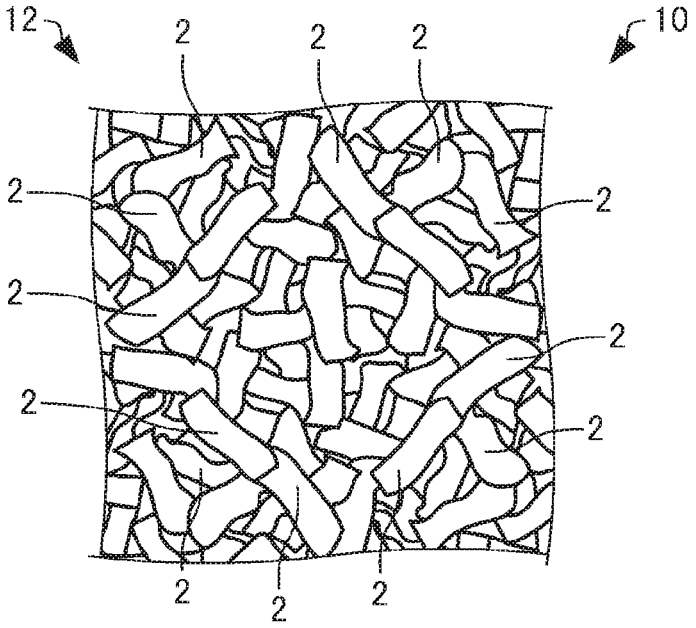
FIG. 3 is a diagram illustrating a liquid absorption member loaded in a liquid absorber, according to an embodiment.
Figure 4:
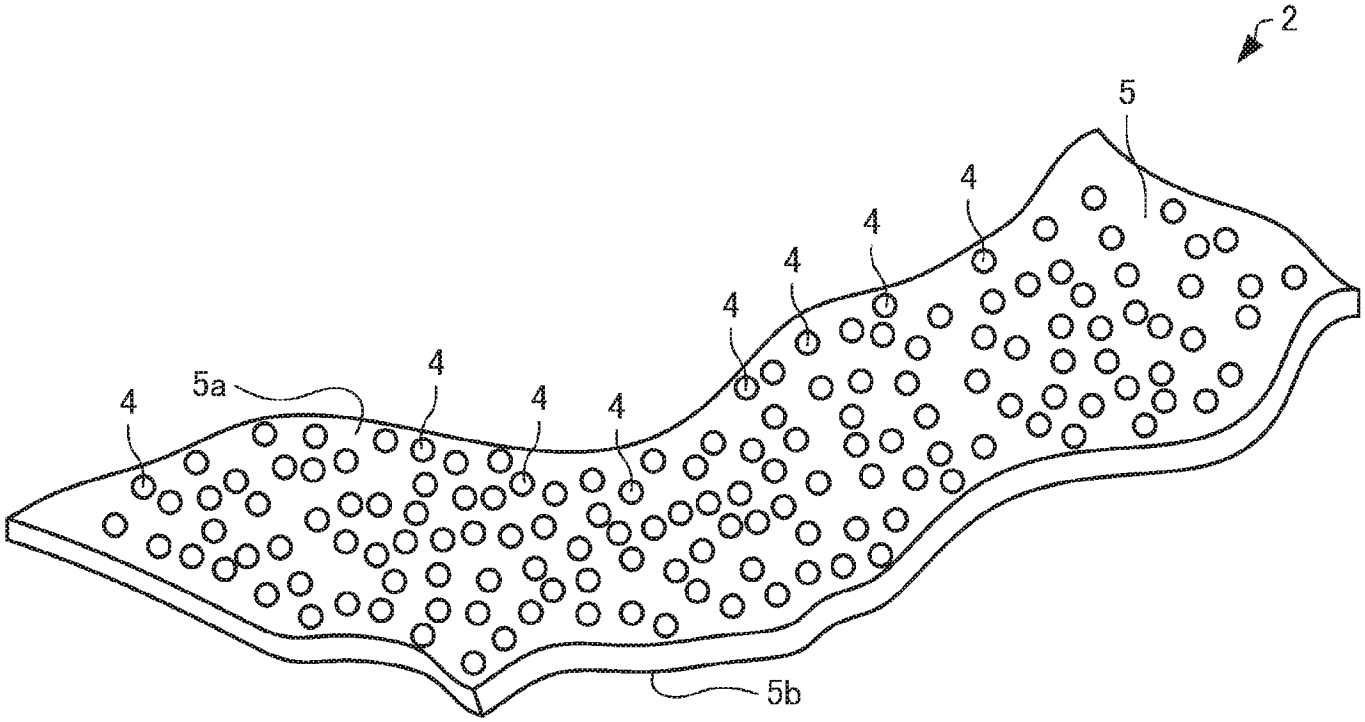
FIG. 4 is a diagram illustrating a small piece that is included in a liquid absorption member, which is loaded in a liquid absorber, according to an embodiment.
Figure 5:
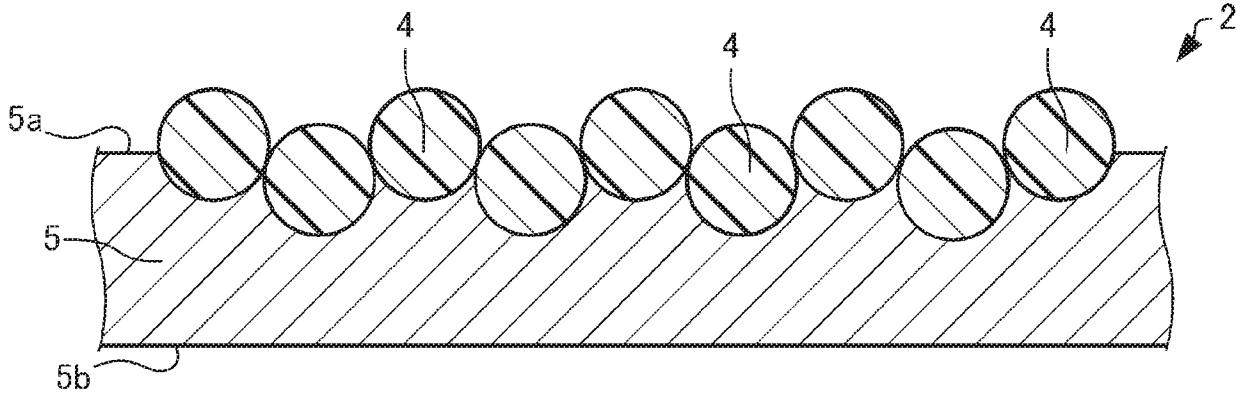
FIG. 5 is a diagram illustrating a small piece that is included in a liquid absorption member, which is loaded in a liquid absorber, according to an embodiment.

FIG. 3 is a diagram illustrating an assembly of small pieces 2, which is included in the liquid absorption member 10. FIG. 4 and FIG. 5 are diagrams illustrating a substrate 5 and a liquid-absorbent resin 4, which are included in the small pieces 2. The substrate 5 includes the individual fibers.

As illustrated in FIG. 3, the absorbing portion 12 includes the small pieces 2. The small pieces 2 are chip-shaped pieces obtained by, for example, finely cutting paper with a shredder or the like. The paper may be a sheet of waste paper or the like on which the liquid-absorbent resin 4 is supported (sheet member 3, which will be described later). It is preferable that the small pieces 2 be strip-shaped pieces having flexibility. With this configuration, the small pieces 2 can be easily deformed. Hence, when the liquid absorption member 10 is stored in the case 30, the absorbing portion 12 is deformed regardless of the shape of the case 30 and, therefore, can be stored therein without difficulty.

A full length of the small pieces 2, that is, a length in a longitudinal direction of the small pieces 2, is preferably 0.5 mm or greater and 200 mm or less, more preferably 1 mm or greater and 100 mm or less, and even more preferably 2 mm or greater and 30 mm or less.

A width of the small pieces 2, that is, a length in a transverse direction of the small pieces 2, is preferably 0.1 mm or greater and 100 mm or less, more preferably 0.3 mm or greater and 50 mm or less, and even more preferably 1 mm or greater and 20 mm or less.

The aspect ratio between the full length and the width of the small pieces 2 is preferably 1 or greater and 200 or less and more preferably 1 or greater and 30 or less. A thickness of the small pieces 2 is preferably 0.05 mm or greater and 2 mm or less and more preferably 0.1 mm or greater and 1 mm or less.

When the above-mentioned ranges are satisfied, the fiber can support a liquid-absorbent resin, hold ink, and deliver the ink to the liquid-absorbent resin in a suitable manner, and, hence, the absorbing portion 12 has excellent absorption characteristics with respect to ink. In addition, the absorbing portion 12 can be easily deformed and, therefore, has improved conformability to the shape of the case 30.

Note that in the absorbing portion 12, some of the small pieces 2 may be the same as one another in terms of at least one of full length, width, aspect ratio, and thickness, and some of the small pieces 2 may be different from one another in terms of length, width, aspect ratio, and thickness.

In the absorbing portion 12, a content of small pieces 2 that have a maximum width less than or equal to 3 mm is preferably 30 wt. % or greater and 90 wt. % or less and more preferably 40 wt. % or greater and 80 wt. % or less. With such a content, variations in ink absorption characteristics of the absorbing portion 12 are prevented from occurring.

If the content of small pieces 2 that have a maximum width less than or equal to 3 mm is less than 30 wt. %, gaps tend to be formed between small pieces 2, which are included in the absorbing portion 12, when the liquid absorption member 10 is stored in the case 30, and as a result, variations in the ink absorption characteristics of the absorbing portion 12 may occur. On the other hand, if the content of small pieces 2 that have a maximum width less than or equal to 3 mm is greater than 90 wt. %, it is difficult to form gaps between small pieces 2, and, therefore, adjustment of a bulk density of the absorbing portion 12 is difficult.

It is preferable that the small pieces 2 have a regular shape. When the small pieces 2 have a regular shape, it is unlikely that variations will occur in the bulk density of the absorbing portion 12, and, therefore, variations in the ink absorption characteristics are prevented from occurring. In the absorbing portion 12, a content of small pieces 2 that have a regular shape is greater than or equal to 30 wt. % relative to the total weight of the absorbing portion 12. The content is preferably greater than or equal to 50 wt. % and more preferably greater than or equal to 70 wt. %.

For example, the small pieces 2 are stored in the case 30 randomly, without regularity, in a manner such that the longitudinal directions of the small pieces 2 do not extend parallel to one another but extend crosswise to one another. Thus, gaps can be easily formed between the small pieces 2. As a result, ink can flow through the gaps, and, when the gaps are very small, ink can wet and spread under capillary action. Accordingly, ink flowability is ensured. Hence, in the case 30, ink flowing downwardly is prevented from being blocked along the way, and as a result, the ink can penetrate to a bottom portion 32*a* of the case 30.

Since the small pieces 2 are stored randomly, the opportunity for the absorbing portion 12 as a whole to come into contact with ink is increased, and, hence, the absorbing portion 12 has excellent absorption characteristics with respect to ink. Furthermore, in the process of storing the liquid absorption member 10 into the case 30, the small pieces 2 can be thrown into the case 30 in a random manner, and, therefore, the operation can be carried out readily and quickly.

The bulk density of the absorbing portion 12 is preferably 0.01 g/cm$^3$ or greater and 0.5 g/cm$^3$ or less, more preferably 0.03 g/cm$^3$ or greater and 0.3 g/cm$^3$ or less, and even more preferably 0.05 g/cm$^3$ or greater and 0.2 g/cm$^3$ or less. Such a bulk density realizes both an ink retention characteristic and an ink penetration characteristic.

1.1.2. Liquid-Absorbent Resin

As illustrated in FIG. 4 and FIG. 5, the particles of the liquid-absorbent resin 4, which are included in the small pieces 2, are supported on the substrate 5. In the illustrated example, the particles of the liquid-absorbent resin 4 are supported only on one surface 5*a* of the substrate 5. Although not illustrated, some or all of the particles of the liquid-absorbent resin 4 may be supported on another surface 5*b* of the substrate 5. Thus, the small piece 2 is formed of the substrates 5 that include the particles of the liquid-absorbent resin supported thereon.

As illustrated in FIG. 5, the particles of the liquid-absorbent resin 4 may be partially embedded in the one surface 5*a* of the substrate 5. That is, the particles of the liquid-absorbent resin 4 may be partially enclosed in the substrate 5. This configuration increases the ability of the substrate 5 to support the particles of the liquid-absorbent resin 4. Hence, the particles of the liquid-absorbent resin 4 are prevented from falling off the substrate 5. As a result, the absorbing portion 12, which is formed of an assembly of the small pieces 2, exhibits excellent absorption characteristics with respect to ink over a long period of time. In addition, uneven distribution of the particles of the liquid-absorbent resin 4 in the case 30 is prevented.

Note that the particles of the liquid-absorbent resin 4 may not be partially embedded in the surface 5*a* of the substrate 5. The particles of the liquid-absorbent resin 4 may be applied to the substrate 5 and may merely adhere to the substrate 5. Furthermore, the individual fibers of the liquid absorption member 10 may not constitute the substrates 5. Alternatively, the individual fibers may be in an entangled state.

The liquid-absorbent resin 4 is a super absorbent polymer (SAP) having liquid absorption characteristics. The term "liquid absorption" refers to properties of having a hydrophilicity and retaining liquid. The liquid-absorbent resin 4 may be gelled by absorption of liquid. Specifically, the liquid-absorbent resin 4 absorbs liquid present in ink, such as water and a hydrophilic organic solvent.

Examples of the liquid-absorbent resin 4 include carboxymethyl cellulose, polyacrylic acids, polyacrylamides, starch-acrylic acid graft copolymers, hydrolysates of starch-acrylonitrile graft copolymers, vinyl acetate-acrylic ester copolymers, isobutylene-maleic acid copolymers, hydrolysates of acrylonitrile copolymers or acrylamide copolymers, polyethylene oxide, polysulfonic acid compounds, polyglutamic acids, salts thereof, modified products thereof, and crosslinked products thereof.

It is preferable that the liquid-absorbent resin 4 be a resin including structural units that contain a functional group in a side chain. Examples of the functional group include acid groups, hydroxyl groups, epoxy groups, and amino groups. In particular, it is preferable that an acid group be present in the side chain of the resin, and it is more preferable that a carboxyl group be present in the side chain of the resin.

Examples of a carboxyl-group-containing unit that may be included in the side chain include units derived from a monomer such as acrylic acid, methacrylic acid, itaconic acid, maleic acid, crotonic acid, fumaric acid, sorbic acid, cinnamic acid, an anhydride of any of the foregoing acids, or a salt of any of the foregoing acids.

When the liquid-absorbent resin 4 is a resin including structural units that contain an acid group in a side chain, a percentage of acid groups of the liquid-absorbent resin 4 that are neutralized and form a salt, relative to the total moles of acid groups in the liquid-absorbent resin 4, is preferably 30 mol % or greater and 100 mol % or less, more preferably 50 mol % or greater and 95 mol % or less, even more preferably 60 mol % or greater and 90 mol % or less, and most preferably 70 mol % or greater and 80 mol % or less. Such a liquid-absorbent resin 4 has excellent absorption characteristics with respect to ink.

Examples of the neutralized salt include alkali metal salts, such as sodium salts, potassium salts, and lithium salts, and salts of a nitrogen-containing basic compound, such as ammonia. In particular, a sodium salt is preferable. Such a liquid-absorbent resin 4 has excellent absorption characteristics with respect to ink.

In a liquid-absorbent resin 4 including structural units that contain an acid group in a side chain, electrostatic repulsion occurs between acid groups during absorption of ink, which increases the absorption rate. Thus, such a liquid-absorbent resin 4 is preferable. Furthermore, in the instance in which acid groups are neutralized, ink can be easily absorbed into the liquid-absorbent resin 4 under osmotic pressure.

The liquid-absorbent resin 4 may have a structural unit in which no acid group is present in a side chain. Examples of such a structural unit include hydrophilic structural units, hydrophobic structural units, and structural units that serve as a polymerizable crosslinking agent.

Examples of the hydrophilic structural units include structural units derived from a nonionic compound, such as acrylamide, methacrylamide, N-ethyl (meth)acrylamide, N-n-propyl (meth)acrylamide, N-isopropyl (meth)acrylamide, N,N-dimethyl (meth)acrylamide, 2-hydroxyethyl (meth)acrylate, 2-hydroxypropyl (meth)acrylate, methoxypolyethylene glycol (meth)acrylate, polyethylene glycol mono(meth)acrylate, N-vinylpyrrolidone, N-acryloylpiperidine, or N-acryloylpyrrolidine.

Examples of the hydrophobic structural units include structural units derived from a compound such as (meth) acrylonitrile, styrene, vinyl chloride, butadiene, isobutene, ethylene, propylene, stearyl (meth)acrylate, or lauryl (meth) acrylate.

Examples of the structural units that serve as a polymerizable crosslinking agent include structural units derived from a compound such as diethyleneglycol diacrylate, N,N-methylenebisacrylamide, polyethylene glycol diacrylate, polypropylene glycol diacrylate, trimethylolpropane diallyl ether, trimethylolpropane triacrylate, allyl glycidyl ether, pentaerythritol triallyl ether, pentaerythritol diacrylate monostearate, bisphenol diacrylate, isocyanurate diacrylate, tetraallyloxyethane, or a salt of diallyloxyacetic acid.

It is preferable that the liquid-absorbent resin 4 include a polyacrylic acid salt copolymer or a crosslinked polyacrylic acid polymer. Such a liquid-absorbent resin 4 exhibits improved ink absorption performance and enables a reduction in production cost, for example.

In the crosslinked polyacrylic acid polymer, a percentage of carboxyl-group-containing structural units relative to the total moles of all the structural units included in the molecular chain is preferably greater than or equal to 50 mol %, more preferably greater than or equal to 80 mol %, and even more preferably greater than or equal to 90 mol %. If the percentage of the carboxyl-group-containing structural units is too low, it may be difficult to ensure a sufficiently good ink absorption characteristic.

It is preferable that some of the carboxyl groups in the crosslinked polyacrylic acid polymer be neutralized and form a salt. In the crosslinked polyacrylic acid polymer, a percentage of neutralized carboxyl groups relative to the total moles of all the carboxyl groups is preferably 30 mol % or greater and 99 mol % or less, more preferably 50 mol % or greater and 99 mol % or less, and even more preferably 70 mol % or greater and 99 mol % or less.

Furthermore, the liquid-absorbent resin 4 may include a crosslinked structure formed with a crosslinking agent other than the polymerizable crosslinking agent mentioned above.

When the liquid-absorbent resin 4 is a resin containing acid groups, it is preferable that the crosslinking agent be, for example, a compound containing acid groups and functional groups that are reactive with acid groups. When the liquid-absorbent resin 4 is a resin containing acid groups and functional groups that are reactive with acid groups, it is preferable that the crosslinking agent be a compound containing, in the molecule, functional groups that are reactive with acid groups.

Examples of the crosslinking agent containing acid groups and functional groups that are reactive with acid groups include glycidyl ether compounds, such as ethylene glycol diglycidyl ether, trimethylolpropane triglycidyl ether, (poly)glycerol polyglycidyl ether, diglycerol polyglycidyl ether, and propylene glycol diglycidyl ether; polyhydric alcohols, such as (poly)glycerol, (poly)ethylene glycol, propylene glycol, 1,3-propanediol, polyoxyethylene glycol, triethylene glycol, tetraethylene glycol, diethanolamine, and triethanolamine; and polyamines and the like, such as ethylenediamine, diethylenediamine, polyethyleneimine, and hexamethylene diamine. Other preferred examples include ions of a multivalent metal, such as zinc, calcium, magnesium, or aluminum. Such ions serve as a crosslinking agent by reacting with acid groups present in the liquid-absorbent resin 4.

The particles of the liquid-absorbent resin 4 may have any shape, such as flaky, acicular, fibrous, or substantially spherical or equiaxed, but it is preferable that most of the particles have a substantially spherical or equiaxed shape. When most of the particles of the liquid-absorbent resin 4 have a substantially spherical or equiaxed shape, ink penetration characteristics can be easily ensured. In addition, the particles of the liquid-absorbent resin 4 can be suitably supported on the fiber. Note that the phrase "substantially spherical or equiaxed shape" refers to a shape having an aspect ratio of 0.3 or greater and 1.0 or less. The aspect ratio is the ratio of a minimum length to a maximum length of the particle. An average particle diameter of the particles is preferably 15 μm or greater and 800 μm or less, more preferably 15 μm or greater and 400 μm or less, and even more preferably 15 μm or greater and 50 μm or less.

Note that the average particle diameter of the particles may be, for example, a mean volume diameter MVD, which is a volume-based mean particle diameter measured with a laser diffraction particle diameter distribution analyzer. Particle diameter distribution analyzers using the laser diffraction light scattering method as the measurement principle, that is, laser diffraction particle diameter distribution analyzers, can measure particle diameter distributions based on volume.

Preferably, a relationship of $0.15 \leq L/D \leq 467$ is satisfied, more preferably, a relationship of $0.25 \leq L/D \leq 333$ is satisfied, and even more preferably, a relationship of $2 \leq L/D \leq 200$ is satisfied, where D is the average particle diameter [μm] of the liquid-absorbent resin 4, and L is the average length [μm] of the individual fibers.

In the absorbing portion 12, a content of the liquid-absorbent resin 4 is preferably 25 wt. % or greater and 300 wt. % or less and more preferably 50 wt. % or greater and 150 wt. % or less, relative to the weight of the fiber. With such a content, a sufficient ink absorption characteristic and ink penetration characteristic are ensured in the absorbing portion 12.

If the content of the liquid-absorbent resin 4 is less than 25 wt. % relative to the weight of the fiber, the liquid absorption characteristics may be insufficient. On the other hand, if the content of the liquid-absorbent resin 4 is greater than 300 wt. % relative to the weight of the fiber, the absorbing portion 12 may tend to swell when the absorbing portion 12 absorbs ink, and as a result, the penetration characteristics may be reduced.

Note that the absorbing portion 12 may include one or more other materials, in addition to the fiber and the liquid-absorbent resin 4. Examples of the one or more other materials include surfactants, lubricants, defoamers, fillers, anti-blocking agents, UV absorbers, colorants, such as pigments and dyes, flame retardants, and flow improvers.

1.2 Bond Layer

As illustrated in FIG. 1, the bond layer 14 is formed in at least an outermost surface (uppermost layer), which is an exposed surface, of the absorbing portion 12. The bond layer 14 is formed by applying or spraying water or a water-soluble resin to a surface of small pieces 2 that are exposed in the outermost surface (uppermost layer) of the liquid absorption member 10. Accordingly, for example, the bond layer 14 includes the fiber and the liquid-absorbent resin 4, and, in the configuration in which a water-soluble resin is applied or sprayed, further includes the water-soluble resin. The above description provided in the section "1.1.1. Fiber" basically applies to the fiber included in the bond layer 14. The above description provided in the section "1.1.2. Liquid-Absorbent Resin" basically applies to the liquid-absorbent resin 4 included in the bond layer 14. The bond layer 14 may absorb ink. The following description describes an example in which the bond layer 14 includes a water-soluble resin.

The water-soluble resin has a bonding force for the materials of the bond layer 14. The water-soluble resin has a bonding force for the small pieces 2. In at least a portion of a surface 10*a* of the liquid absorption member 10, the materials (small pieces 2) of the liquid absorption member 10 are bonded together with a bonding force of the water-soluble resin. The surface 10*a* is a surface adjacent to an opening portion 35. In the illustrated example, the materials of the liquid absorption member 10 are bonded together in a region of the surface 10*a*, with the bonding force of the water-soluble resin. The region is a region other than the portion that defines a second recessed portion 18. In addition, the water-soluble resin may have a bonding force for the liquid-absorbent resin 4.

The materials of the bond layer 14 may be bonded to sidewall portions 32*b* of the case 30 with the water-soluble resin. Specifically, small pieces 2 included in the bond layer 14 may be bonded to the sidewall portions 32*b* with the water-soluble resin. Note that, in the example illustrated in FIG. 1, the bond layer 14 is a smooth and uniformly continuous layer, but a surface of the bond layer 14 may have an irregular shape, and/or the bond layer 14 may be formed of a plurality of separate portions.

In instances in which an aqueous ink is used, the water-soluble resin dissolves when the water-soluble resin comes into contact with the ink. Thus, even if a water-soluble resin adheres to a surface of the liquid-absorbent resin 4, it is possible to prevent the absorption of ink performed by the liquid-absorbent resin 4 from being interfered with by the water-soluble resin.

Example of the water-soluble resin include proteins, such as casein, soy protein, and synthetic protein; various starches, such as starch and oxidized starch; polyvinyl alcohols, which include polyvinyl alcohol and modified polyvinyl alcohols, such as cationic polyvinyl alcohols and silyl-modified polyvinyl alcohols; cellulose derivatives, such as carboxymethyl cellulose and methylcellulose; aqueous polyurethane resins; and aqueous polyester resins. In particular, a polyvinyl alcohol is preferable in terms of bonding force.

In the bond layer 14, a content of the water-soluble resin is preferably 0.1 wt. % or greater and 20 wt. % or less and more preferably 1 wt. % or greater and 10 wt. % or less, relative to the weight of the fiber. When the content is within such a range, the small pieces 2 can be bonded together sufficiently in the bond layer 14.

Note that the absorbing portion 12 may include a water-soluble resin. In this instance, the bonding force of the water-soluble resin enables the substrate 5 and the liquid-absorbent resin 4 to be bonded together and the state in which the liquid-absorbent resin 4 is supported on the substrate 5 to be maintained. However, a content of the water-soluble resin in the absorbing portion 12 relative to the weight of the fiber is less than a content of the water-soluble resin in the bond layer 14 relative to the weight of the fiber. In the absorbing portion 12, the content of the water-soluble resin is preferably 0.1 wt. % or greater and 20 wt. % or less and more preferably 1 wt. % or greater and 20 wt. % or less, relative to the weight of the fiber. When the content is within such a range, the substrate 5 and the liquid-absorbent resin 4 can be bonded together while ensuring the conformability of the absorbing portion 12 to the shape of the case 30.

1.3. Recessed Portion Disposed in Liquid Absorption Member

As illustrated in FIG. 1 and FIG. 2, a first recessed portion 16 and the second recessed portion 18 are disposed in the liquid absorption member 10.

The first recessed portion 16 is disposed in a location corresponding to the opening portion 35. That is, the first recessed portion 16 overlaps the opening portion 35 in plan view. The opening portion 35 is located inside the outer edge of the first recessed portion 16 in plan view. The recessed shape of the inner surface of the first recessed portion 16 is maintained by the bond layer 14. A depth of the first recessed portion 16 is greater than, for example, half of a thickness of the liquid absorption member 10. When ink is to be discharged from the tube 406, the tube 406 is inserted into the first recessed portion 16 to discharge the ink, as illustrated in FIG. 1.

The second recessed portion 18 is disposed at a distance from the first recessed portion 16. The inner surface of the second recessed portion 18 is formed of the absorbing portion 12 and the bond layer 14. In the illustrated example, a recessed portion 18*a* is disposed in the absorbing portion 12, a through-hole 18*b* is disposed in the bond layer 14, and the recessed portion 18*a* and the through-hole 18*b* form the second recessed portion 18. A depth of the second recessed portion 18 is less than a depth of the first recessed portion 16, for example. In the example illustrated in FIG. 2, the shapes of the first recessed portion 16 and the second recessed portion 18 are quadrilateral shapes. However, the shapes may be, for example, circular shapes, that is, the shapes are not particularly limited.

1.4. Porous Liquid Absorption Member

The porous liquid absorption member 20 is disposed in the second recessed portion 18. The porous liquid absorption member 20 includes a projecting portion 22, which projects from the second recessed portion 18. The projecting portion 22 is not covered with the bond layer 14.

The porous liquid absorption member 20 includes materials that include a fiber and a fused resin. The above description provided in the section "1.1.1. Fiber" basically applies to the fiber included in the porous liquid absorption member 20.

It should be noted that the individual fibers included in the porous liquid absorption member 20 do not constitute the substrates 5. The porous liquid absorption member 20 is a member formed by mixing together individual fibers and A fusible resin and heating the mixture to melt the fusible resin, thereby fusing together the individual fibers and the fused resin, and solidifying the resultant. Note that it is preferable that the individual fibers be fused together at a temperature such that the fiber does not undergo thermal degradation. Furthermore, it is preferable that the fusible resin be a fibrous resin, which can be easily entangled with the individual fibers.

The porous liquid absorption member 20 has a bulk density higher than the bulk density of the liquid absorption member 10. The porous liquid absorption member 20 has a bulk density higher than the bulk density of the absorbing portion 12. The bulk density of the porous liquid absorption member 20 is preferably 0.05 g/cm$^3$ or greater and 0.8 g/cm$^3$ or less, more preferably 0.08 g/cm$^3$ or greater and 0.5 g/cm$^3$ or less, and even more preferably 0.1 g/cm$^3$ or greater and 0.3 g/cm$^3$ or less. The bulk density is calculated by dividing the weight of the liquid absorption member by the volume of the liquid absorption member.

The porous liquid absorption member 20 absorbs ink. However, the porous liquid absorption member 20 has lower ink absorption characteristics than the liquid absorption member 10 because the porous liquid absorption member 20 does not include the liquid-absorbent resin 4 and has a higher bulk density than the liquid absorption member 10.

The fused resin that is included in the porous liquid absorption member 20 is, for example, a thermoplastic resin. Examples of the thermoplastic resin include polyvinyl acetate, polyvinyl alcohol, polyvinyl butyral, polystyrene, ABS (acrylonitrile butadiene styrene) resins, methacrylic resins, Noryl resins, polyurethane, ionomer resins, cellulose-based plastics, polyethylene, polypropylene, polyamide, polycarbonate, polyacetal, polyphenylene sulfide, polyvinylidene chloride, polyethylene terephthalate, and fluorocarbon resins.

The materials of the porous liquid absorption member 20 may include a flame retardant. The flame retardant may be added to impart flame retardancy to the porous liquid absorption member 20. Examples of the flame retardant include inorganic materials, such as aluminum hydroxide and magnesium hydroxide, and organic materials, such as aromatic phosphate esters, examples of which include triphenyl phosphate.

Although not illustrated, the liquid absorber 100 may not include the porous liquid absorption member 20, and the second recessed portion 18 may not be provided. In such a configuration, the materials of the liquid absorption member 10 may be bonded together in the entirety of the surface 10*a*.

1.5. Case

As illustrated in FIG. 1, the liquid absorption member 10 and the porous liquid absorption member 20 are stored in the case 30. The case 30 includes a body 32 and the cover 34.

For example, the body 32 includes a bottom portion 32*a*, which has a quadrilateral plan-view shape, and the four sidewall portions 32*b*, which are disposed along the respective sides of the bottom portion 32*a*. The body 32 has a shape that has an open upper end. Note that the plan-view shape of the bottom portion 32*a* is not limited to a quadrilateral shape and may be, for example, a circular shape.

A ratio V2:V1, where V1 is the volume of the body 32, and V2 is the total volume of the liquid absorption member 10 prior to absorption of ink, is 0.1 or greater and 0.7 or less, for example, and preferably 0.2 or greater and 0.7 or less.

It is preferable that the body 32 have a degree of shape retainability such that the volume V1 does not change by 10% or greater when an internal pressure or an external force acts on the body 32. With such a degree of shape retainability, the body 32 can maintain its shape even when the absorbing portion 12 absorbs ink and swells and thereby causes the body 32 to receive a force from the absorbing portion 12. As a result, the installation state of the case 30 is stabilized, and consequently the liquid absorption member 10 can absorb ink in a consistent manner.

For example, a material of the body 32 is a resin material, such as a cyclic polyolefin or a polycarbonate, or a metal material, such as aluminum or stainless steel.

The cover 34 closes an opening 33 of the body 32. A shape of the cover 34 is a plate shape, for example. The opening portion 35 is disposed in the cover 34. The tube 406 can be coupled through the opening portion 35. The opening portion 35 is a through-hole that extends through the cover 34 in a thickness direction thereof. When ink is to be discharged to the liquid absorber 100, the tube 406 is coupled through the opening portion 35 to discharge the ink through the tube 406.

A thickness of the cover 34 is preferably 1 mm or greater and 20 mm or less and more preferably 8 mm or greater and 10 mm or less. Note that the cover 34 is not limited to a plate-shaped cover that satisfies a numerical range such as those mentioned above, and that the cover 34 may be a film-shaped cover having a smaller thickness. In such a configuration, the thickness of the cover 34 is preferably 10 μm or greater and less than 1 mm.

1.6. Features

The liquid absorber 100 has the following features, for example.

The liquid absorber 100 includes the liquid absorption member 10 that absorbs ink and the case 30 in which the liquid absorption member 10 is stored. The liquid absorption member 10 includes materials that include the fiber and the liquid-absorbent resin 4. The case 30 includes the opening portion 35. The materials of the liquid absorption member 10 are bonded together in at least a portion of the surface 10*a*, which is a surface adjacent to the opening portion 35.

With this configuration, in the liquid absorber 100, uneven distribution of the individual fibers of the liquid absorption member 10 is unlikely to occur when, for example, the liquid absorber 100 is transferred, compared with a configuration in which the materials of the liquid absorption member are not bonded together in a surface. As a result, good absorption characteristics are achieved. In addition, for example, a shape of the first recessed portion 16 can be provided and maintained for preventing ink from spilling to the outside during the discharging of the ink, which may otherwise occur due to formation of bubbles. In addition, even when the liquid absorption member 10 emits dust, the dust is reliably prevented from rising up compared with a configuration in which the materials of the liquid absorption member are not bonded together in a surface.

In addition, the liquid absorption member 10 has a reduced bulk density compared with a liquid absorption member formed by fusing together individual fibers with a fused resin, and, therefore, the liquid absorption member 10 has excellent absorption characteristics with respect to ink. Specifically, a large area of contact between ink and the fiber is ensured, and, therefore, the fiber can hold the ink temporarily. Subsequently, the ink can be delivered from the fiber to the liquid-absorbent resin 4. Accordingly, the liquid absorption member 10 has excellent absorption characteristics with respect to ink.

In addition, the liquid absorption member 10 has improved conformability to the shape of the case 30 compared with a liquid absorption member formed by fusing together individual fibers with a fused resin. Hence, the liquid absorption member 10 is highly versatile, and the production cost can be reduced.

In the liquid absorber 100, the materials of the liquid absorption member 10 include a water-soluble resin, and materials (small pieces 2) of the liquid absorption member 10 are bonded together in at least a portion of the surface 10*a* with a bonding force of the water-soluble resin. As a result, a high bonding force is exhibited in the liquid absorber 100 compared with a configuration in which small pieces are bonded together without using a water-soluble resin, for example, with an adhesive force generated by swelling of the liquid-absorbent resin.

In the liquid absorber 100, the materials of the liquid absorption member 10 are bonded to the sidewall portions 32*b* of the case 30 with a water-soluble resin. As a result, in the liquid absorber 100, uneven distribution of the individual fibers of the liquid absorption member 10 is unlikely to occur compared with a configuration in which the materials of the liquid absorption member are not bonded to the sidewall portions of the case.

In the liquid absorber 100, the first recessed portion 16 is disposed in a location corresponding to the opening portion 35, in the surface 10*a* of the liquid absorption member 10. Accordingly, in the liquid absorber 100, the first recessed portion 16 prevents ink from spilling to the outside during the discharging of the ink, which may otherwise occur due to formation of bubbles. In particular, matte black inks and the like have a high surfactant content and are therefore susceptible to bubble formation.

In the liquid absorber 100, the liquid absorption member 10 is formed of an assembly of the small pieces 2. Each of the small pieces 2 includes the substrate 5 and the liquid-absorbent resin 4. The substrate 5 includes the individual fibers, and the liquid-absorbent resin 4 is supported by the substrate 5. This configuration of the liquid absorber 100 reliably prevents dust emission compared with a configuration in which the individual fibers do not constitute substrates but are in an entangled state.

In the liquid absorber 100, the porous liquid absorption member 20 for absorbing ink is disposed in the second recessed portion 18, with a portion of the porous liquid absorption member 20 projecting from the liquid absorption member 10. Accordingly, in the liquid absorber 100, when ink penetrates to the bottom portion 32*a* of the case 30, the porous liquid absorption member 20 can draw up the ink with capillary action, and liquid in the drawn ink can be released from the projecting portion 22 of the porous liquid absorption member 20. Hence, ink discharged to the liquid absorption member 10 can be easily dried. The porous liquid absorption member 20 has a bulk density higher than that of the liquid absorption member 10 and has a high fiber density, and, therefore, ink can be easily drawn up by capillary action.

2. Method for Producing Liquid Absorption Member

A method for producing the liquid absorption member 10 according to an embodiment will now be described with reference to the drawings. FIG. 6 to FIG. 9 are diagrams illustrating the method for producing the liquid absorption member 10.

Figure 6:
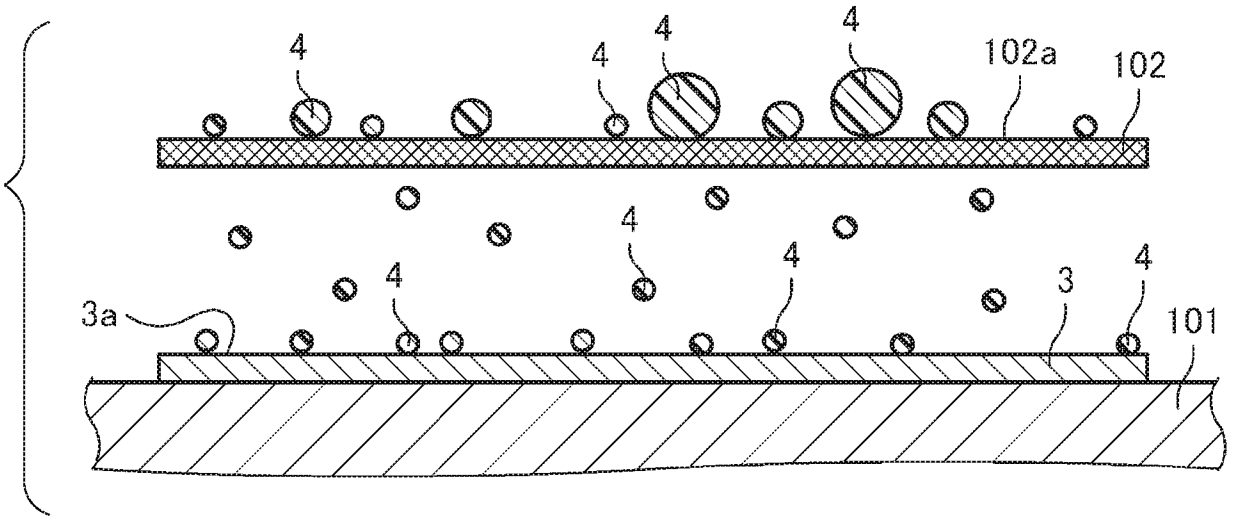
FIG. 6 is a diagram illustrating a method for producing a liquid absorption member of a liquid absorber, according to an embodiment.

As illustrated in FIG. 6, a sheet-shaped sheet member 3 (e.g., waste paper) is laid on a bench 101. Water (or a water-soluble resin) is applied and spread on the sheet member 3 that has been laid.

Next, the particles of the liquid-absorbent resin 4 are applied to one surface 3*a* of the sheet member 3 through a mesh member 102. The mesh member 102 has openings 102*a*. Among the particles of the liquid-absorbent resin 4, particles larger than the openings 102*a* are retained on the mesh member 102, and particles smaller than the opening 102*a* pass through the openings 102*a* and are applied to the surface 3*a* of the sheet member 3. Accordingly, with an adhesive force of the liquid-absorbent resin 4, which is exhibited as a result of absorption of water, (or with a bonding force of a water-soluble resin), the liquid-absorbent resin 4 is fixed to the surface 3*a* of the sheet member 3 and supported thereon.

Thus, the use of the mesh member 102 increases the uniformity of the particle diameters of the liquid-absorbent resin 4. Hence, variations in the absorption characteristics are prevented from occurring in different locations of the sheet member 3.

A maximum width of the openings 102*a* is preferably 0.06 mm or greater and 0.15 mm or less and more preferably 0.08 mm or greater and 0.12 mm or less. With this configuration, the particle diameters of the liquid-absorbent resin 4 applied to the sheet member 3 fall within the numerical range mentioned above.

Figure 7:
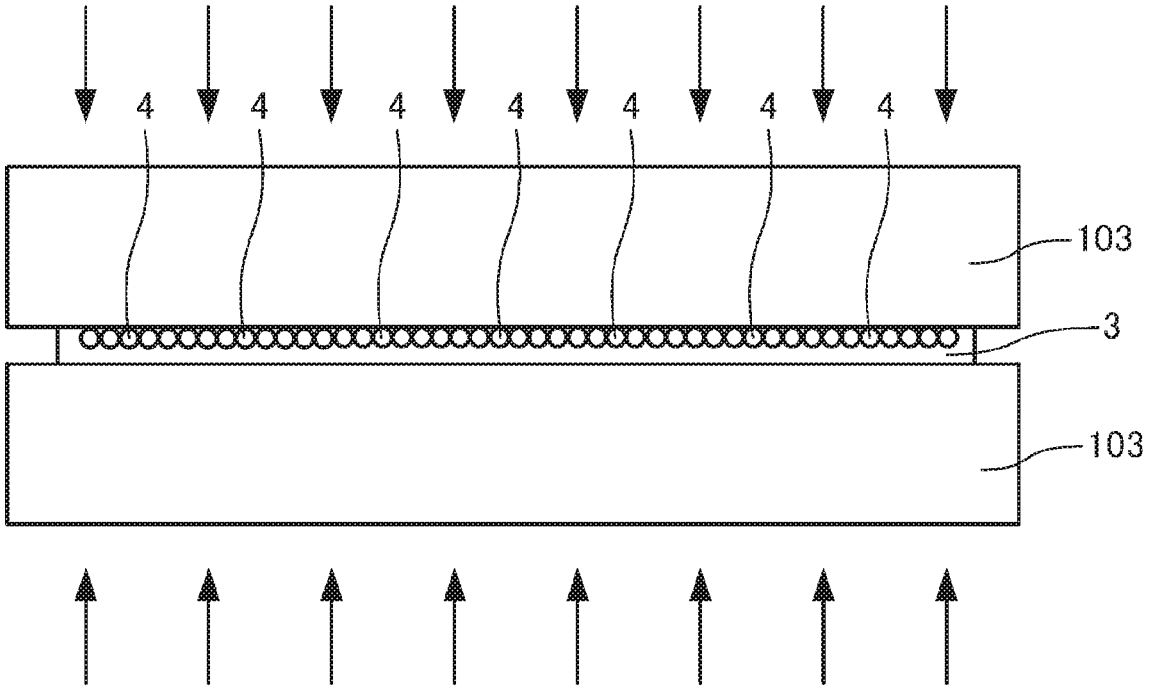
FIG. 7 is a diagram illustrating the method for producing a liquid absorption member of a liquid absorber, according to an embodiment.

As illustrated in FIG. 7, the sheet member 3, to which the particles of the liquid-absorbent resin 4 adhere, is positioned between a pair of heating blocks 103. Subsequently, the pair of heating blocks 103 is heated, and a pressure is applied in a direction in which a distance between the pair of heating blocks 103 decreases, thereby applying a pressure to the sheet member 3 in a thickness direction thereof. Accordingly, the particles of the liquid-absorbent resin 4 are softened, and the particles of the liquid-absorbent resin 4 are embedded in the sheet member 3 as a result of the application of pressure.

In this step, the force of the pressure is preferably 0.1 $kg/cm^2$ or greater and 1.0 $kg/cm^2$ or less and more preferably 0.2 $kg/cm^2$ or greater and 0.8 $kg/cm^2$ or less. In this step, the heating temperature is preferably 80° C. or higher and 160° C. or lower and more preferably 100° C. or higher and 120° C. or lower.

Next, the sheet member 3 is finely cut, crushed, or ground with scissors, a cutter, a mill, a shredder, or the like or finely torn by hand, for example, thereby forming the liquid absorption member 10 including the small pieces 2. Subsequently, the liquid absorption member 10 is weighed out to a desired amount. Thereafter, the liquid absorption member 10 is, for example, loosened up by hand to adjust the bulk density and stored in the body 32 of the case 30.

Figure 8:
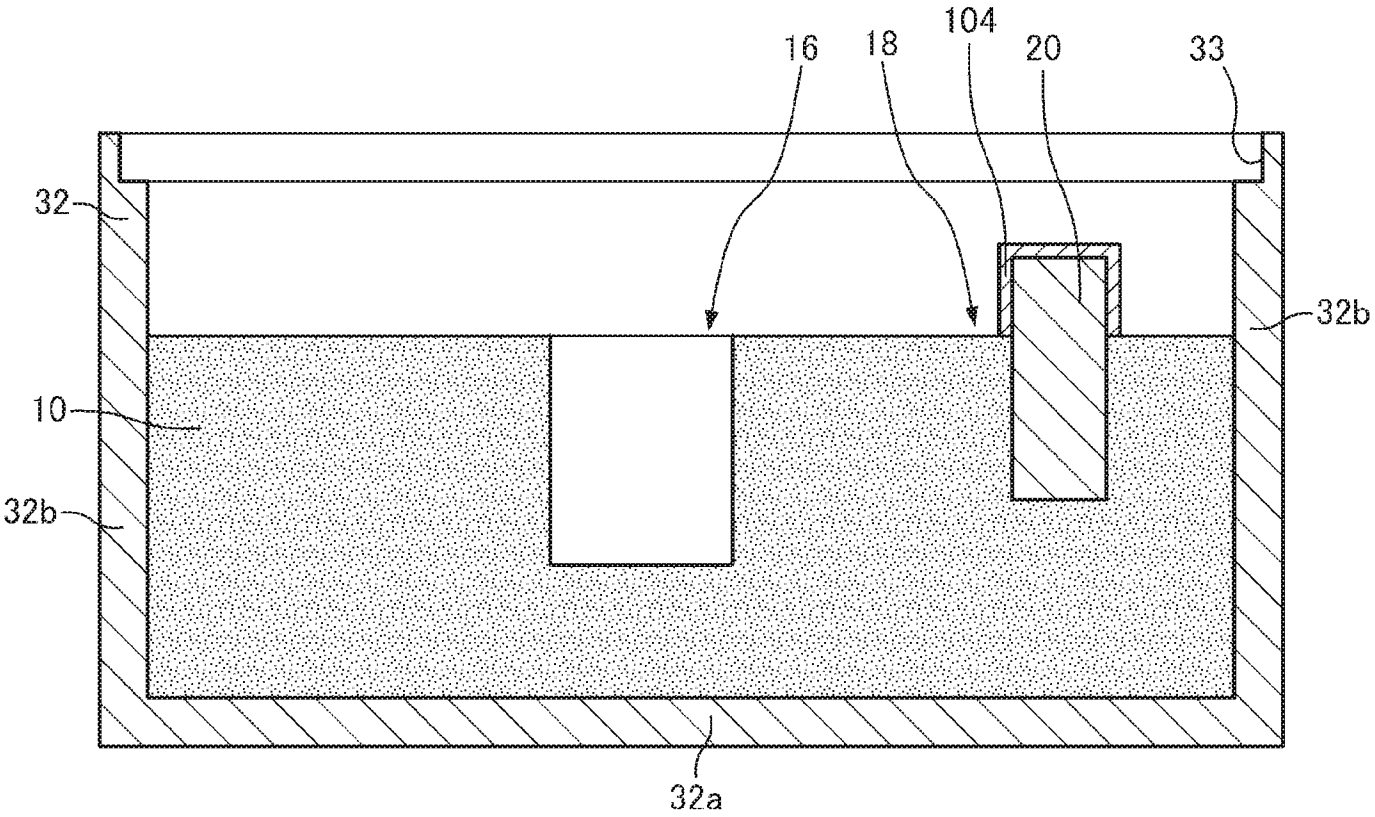
FIG. 8 is a diagram illustrating the method for producing a liquid absorption member of a liquid absorber, according to an embodiment.

As illustrated in FIG. 8, the porous liquid absorption member 20 is pressed into the liquid absorption member 10. Accordingly, the second recessed portion 18 is formed in the liquid absorption member 10, with the projecting portion 22 of the porous liquid absorption member 20 projecting from the liquid absorption member 10.

A method for forming the porous liquid absorption member 20 is as follows. First, a mixture in which individual fibers and a fusible resin are mixed together is sieved through a screen so that the sieved mixture accumulates below the screen. Next, the accumulated mixture is pressurized and heated. Accordingly, the fusible resin is fused to form a member having a desired thickness. Subsequently, the member is die cut to desired dimensions to form the porous liquid absorption member 20.

Next, the projecting portion 22 of the porous liquid absorption member 20 is covered with a mask layer 104. The mask layer 104 is in the form of a film, for example. The material of the mask layer 104 is not particularly limited provided that the mask layer 104 can be removed from the projecting portion 22.

Next, a rod-shaped member (not illustrated) is pressed into the liquid absorption member 10 to form the first recessed portion 16 in the liquid absorption member 10. Subsequently, after the rod-shaped member is removed from the liquid absorption member 10 and before the shape of the first recessed portion 16 is lost, a water-soluble resin is applied to the entire surface by spraying. Thereafter, the mask layer 104 is removed. In this manner, the bond layer 14 can be formed, as illustrated in FIG. 1. Since the projecting portion 22 is covered with the mask layer 104 during the spraying of the water-soluble resin, the bond layer 14 is not formed on the projecting portion 22. The spraying of the water-soluble resin may be carried out by, for example, spraying an aqueous solution of polyvinyl alcohol containing 95 g of water and 5 g of polyvinyl alcohol. Thereafter, the cover 34 is fitted to the body 32.

With the steps described above, the liquid absorber 100 can be produced.

Figure 9:
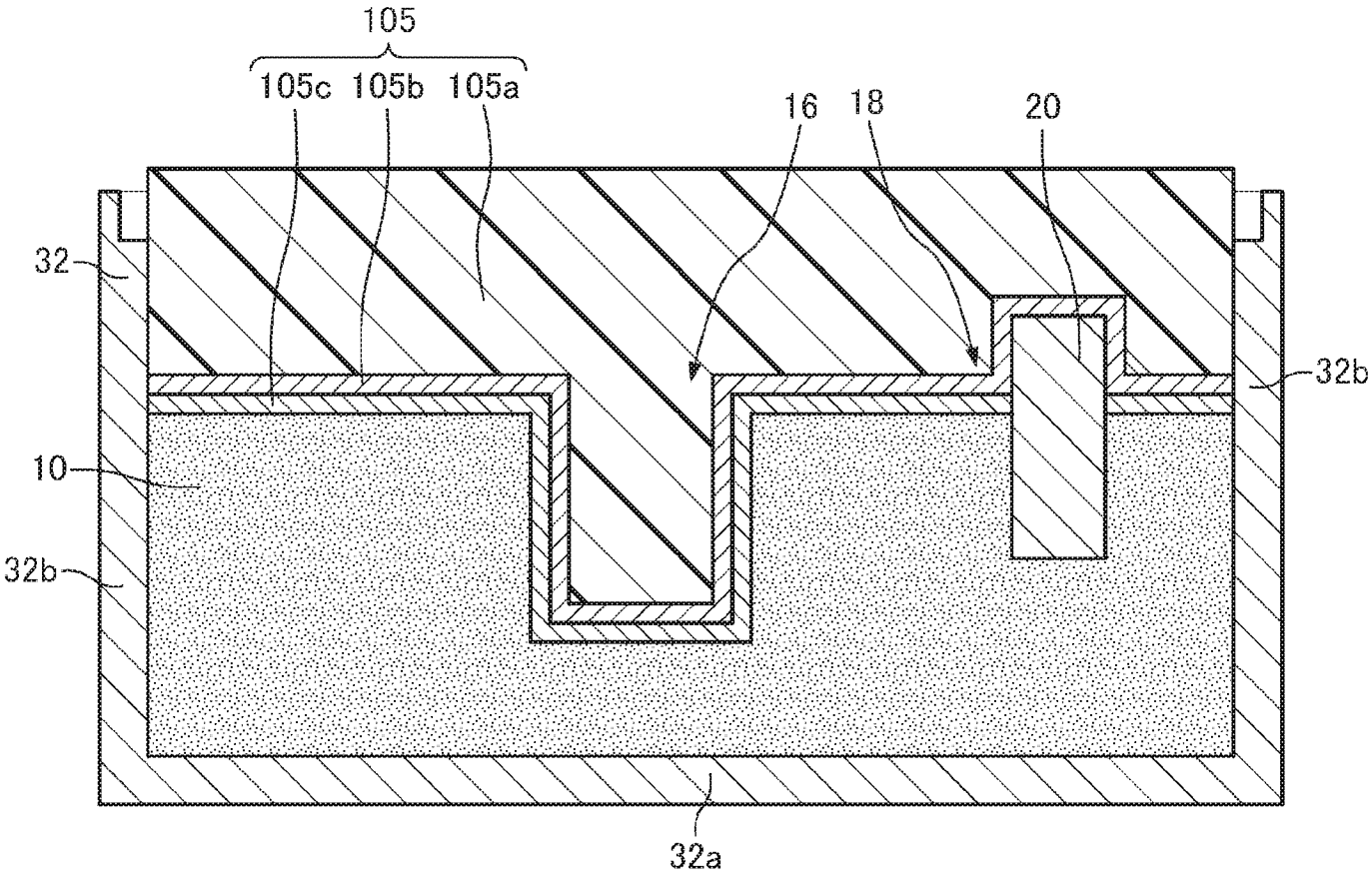
FIG. 9 is a diagram illustrating the method for producing a liquid absorption member of a liquid absorber, according to an embodiment.

Note that the method for applying the water-soluble resin is not limited to spraying. For example, the following method may be used. As illustrated in FIG. 9, a mold member 105 is prepared. The mold member 105 includes a base portion 105*a*, a release layer 105*b*, and a resin layer 105*c*. The release layer 105*b* includes a release agent and is disposed on the base portion 105*a*. The resin layer 105*c* includes a water-soluble resin and is disposed on the release layer 105*b*. The mold member 105 is pressed against the liquid absorption member 10. After a predetermined period of time elapses, the mold member 105 is removed from the liquid absorption member 10. Since the release layer 105*b* is disposed between the base portion 105*a* and the resin layer 105*c*, the base portion 105*a* and the resin layer 105*c* are separated from each other when the mold member 105 is removed from the liquid absorption member 10. The resin layer 105*c* is retained in the liquid absorption member 10 and forms the bond layer 14. With this method, the first recessed portion 16 and the bond layer 14 can be formed in the same step. The release agent of the release layer 105*b* may be a silicone-based release agent, for example.

3. Modified Examples of Liquid Absorber 3.1. First Modified Example

A liquid absorber according to a first modified example of an embodiment will now be described. In the following description, the liquid absorber according to the first modified example of the embodiment will be described regarding features different from those of the example of the liquid absorber 100 of the above-described embodiment. Features common between the two examples will not be described. This applies to liquid absorbers of second and third modified examples of embodiments, which will be described later.

In the liquid absorber 100 described above, the materials of the liquid absorption member 10 are bonded together in at least a portion of the surface 10*a* with a bonding force of a water-soluble resin.

In contrast, in the liquid absorber according to the first modified example, the materials of the liquid absorption member 10 are bonded together in at least a portion of the surface 10*a* with an adhesive force generated by swelling of the liquid-absorbent resin.

In a method for producing the liquid absorber according to the first modified example, the liquid absorption member 10 is stored in the body 32 of the case 30, and thereafter, water is sprayed onto the surface 10*a*. Accordingly, the liquid-absorbent resin 4 swells and exhibits an adhesive force and thus can bond the small pieces 2 together. In this manner, the bond layer 14 is formed. Note that the method for applying water is not limited to spraying. When water is applied or sprayed, the liquid-absorbent resin 4 supported on the substrate 5 swells and becomes gelled and therefore exhibits tackiness, and consequently, at least some of the small pieces 2 are bonded together to form the bond layer 14. Furthermore, some of the small pieces 2 are bonded to the sidewall portions 32*b* of the case 30 with the adhesive force due to tackiness exhibited by the liquid-absorbent resin 4 when the liquid-absorbent resin 4 absorbs water as a result of application or spraying of water. Furthermore, the bond layer 14 can also be formed on other regions, in addition to the outermost surface (uppermost layer) of the absorbing portion 12. When an appropriate amount of additional water is applied or sprayed, the water travels along the sidewall portions 32*b* of the case 30 to penetrate to a lower region of the case 30. As a result, with the adhesive force described above, fixation and retention between the case 30 and the absorbing portion 12 is further enhanced, namely, between the absorbing portion 12 and the sidewall portions 32*b* (inner wall portions not exposed to the surface) of the case 30 and between the absorbing portion 12 and the bottom portion 32*a* of the case 30. That is, the bond layer 14 is also formed between the absorbing portion 12 and the sidewall portions 32*b* of the case 30 and between the absorbing portion 12 and the bottom portion 32*a* of the case 30.

The amount of water that may be applied is preferably 10 wt. % or greater and 500 wt. % or less and more preferably 50 wt. % or greater and 200 wt. % or less, relative to the weight of the fiber of the liquid absorption member 10. When the amount is within such a range, the small pieces 2 can be bonded together sufficiently in the bond layer 14.

In the liquid absorber according to the first modified example, the materials of the liquid absorption member 10 are bonded together in at least a portion of the surface 10*a* with an adhesive force generated by swelling of the liquid-absorbent resin. Accordingly, the production cost can be reduced compared with a configuration in which, for example, the materials of the liquid absorption member 10 are bonded together with a bonding force of a water-soluble resin.

Note that when it is desired to enhance the bonding force of the bond layer 14, it is preferable to use a water-soluble resin as with the liquid absorber 100.

Furthermore, in the liquid absorber 100 described above, in an instance in which, for example, the water-soluble resin to be applied is an aqueous solution containing water-soluble resin, such as an aqueous solution of polyvinyl alcohol, the materials of the liquid absorption member 10 may be adhesively bonded together with a bonding force of the water-soluble resin and an adhesive force generated by swelling of the liquid-absorbent resin 4. In such an instance, the bonding force of the bond layer 14 is further increased.

3.2. Second Modified Example

Figure 10:
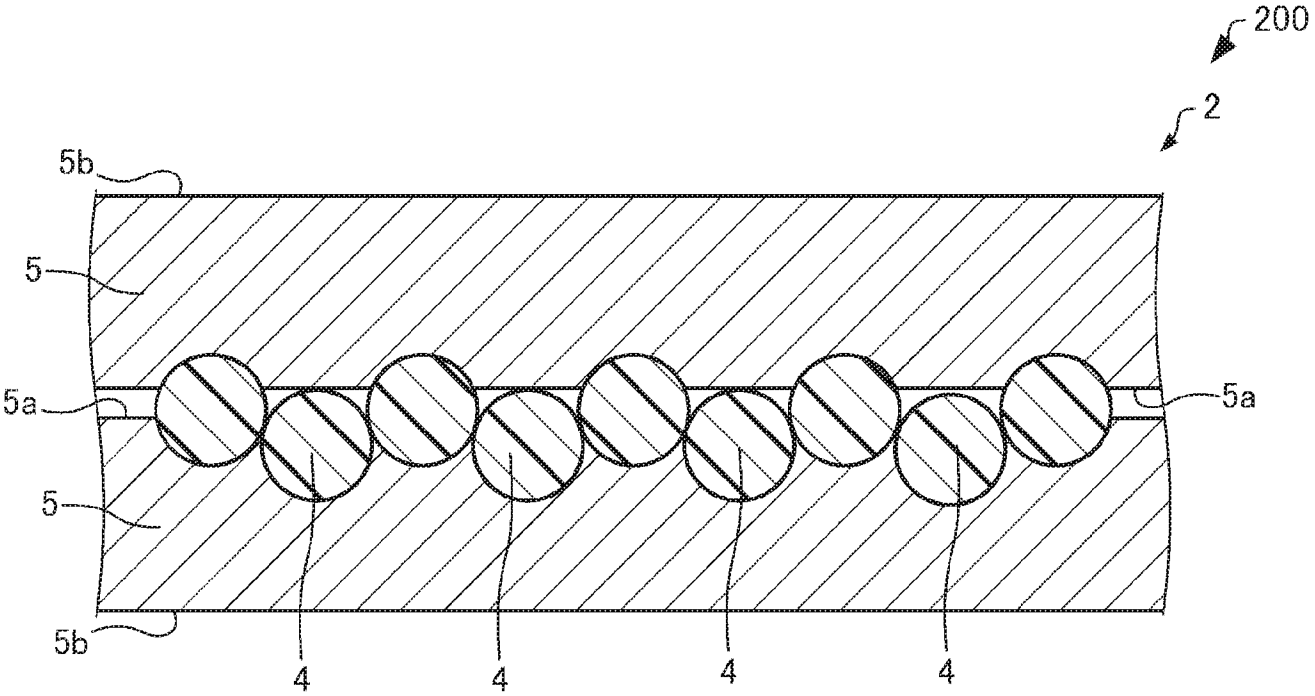
FIG. 10 is a diagram illustrating a small piece that is included in a liquid absorption member, which is loaded in a liquid absorber, according to a second modified example of an embodiment.

A liquid absorber according to a second modified example of an embodiment will now be described with reference to the drawings. FIG. 10 is a diagram illustrating a substrate 5 and a liquid-absorbent resin 4, which are included in small pieces 2 of a liquid absorber 200, according to the second modified example of the embodiment. The substrate 5 includes individual fibers.

The liquid absorber 200 is different from the above-described liquid absorber 100 in that the liquid-absorbent resin 4 is held between a pair of portions of the substrate 5, as illustrated in FIG. 10.

In the liquid absorber 200, the liquid-absorbent resin 4 is held between a pair of portions of the substrate 5, and, therefore, the liquid-absorbent resin 4 is unlikely to fall off the substrates 5 compared with a configuration in which the liquid-absorbent resin 4 is not held between portions of the substrate 5. Accordingly, excellent absorption characteristics with respect to ink are exhibited over a long period of time. In addition, the particles of the liquid-absorbent resin 4 are prevented from being unevenly distributed in the case 30, and, therefore, variations in the ink absorption characteristics are prevented from occurring.

Figure 11:
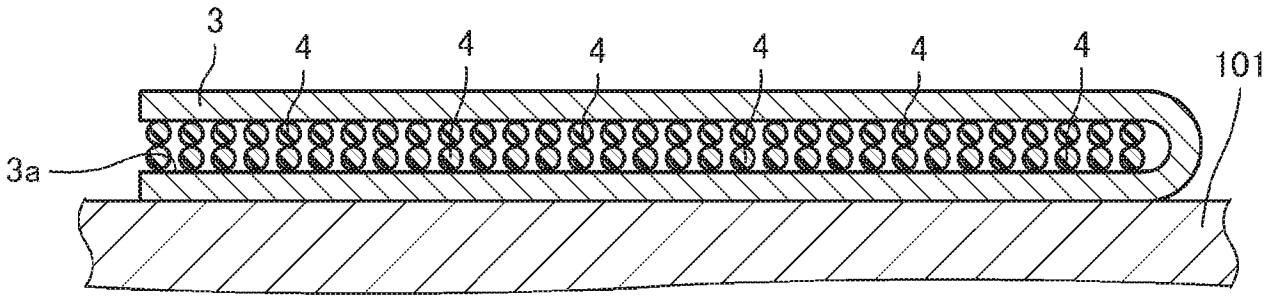
FIG. 11 is a diagram illustrating a method for producing a liquid absorption member of a liquid absorber, according to the second modified example of the embodiment.
Figure 12:
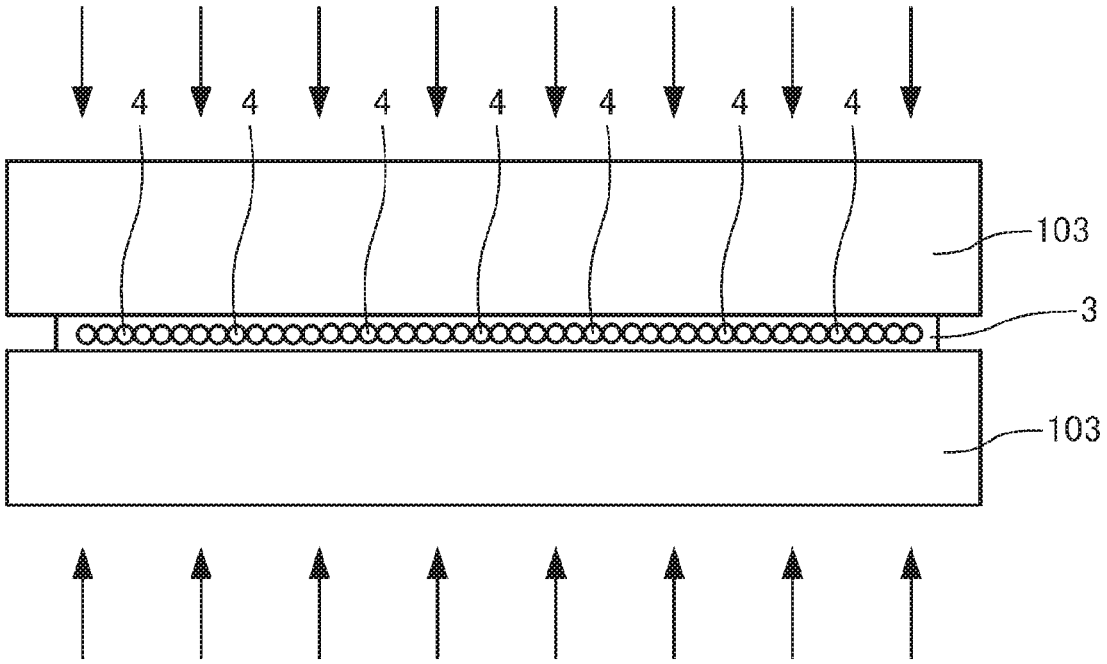
FIG. 12 is a diagram illustrating the method for producing a liquid absorption member of a liquid absorber, according to the second modified example of the embodiment.

A method for producing the liquid absorption member 10 of the liquid absorber 200 will now be described with reference to the drawings. FIG. 11 and FIG. 12 are diagrams illustrating the method for producing the liquid absorption member 10 of the liquid absorber 200.

As illustrated in FIG. 11, the particles of the liquid-absorbent resin 4 are applied to the sheet member 3 laid on the bench 101, and thereafter, the sheet member 3 is folded in a manner such that the surface 3*a*, which includes the applied particles of the liquid-absorbent resin 4, is located on the inner side.

As illustrated in FIG. 12, the folded sheet member 3 is positioned between the pair of heating blocks 103. Subsequently, the pair of heating blocks 103 is heated, and a pressure is applied in a direction in which a distance between the pair of heating blocks 103 decreases, thereby applying a pressure to the sheet member 3 in a thickness direction thereof. Accordingly, the particles of the liquid-absorbent resin 4 are softened by being heated, and the particles of the liquid-absorbent resin 4 are embedded in the sheet member 3 as a result of the application of pressure. Furthermore, particles of the liquid-absorbent resin 4 that come into contact with one another as a result of the folding are softened and joined together. Subsequently, the heating and pressure application are discontinued, and accordingly, the folded halves of the sheet member 3, which overlap each other, are joined together with the particles of the liquid-absorbent resin 4.

Next, the sheet member 3 is cut with a shredder or the like. The subsequent steps are basically the same as those of the above-described method for producing the liquid absorber 100.

In the method for producing the liquid absorption member 10 of the liquid absorber 200, the configuration including multilayers of the sheet member 3 is realized by the simple process, that is, by applying the liquid-absorbent resin 4 to a single sheet member 3 and folding the sheet member 3. That is, there is no need to apply the liquid-absorbent resin 4 to two sheet members 3 separately. Accordingly, the production process is simplified.

In addition, in the sheet member 3, the surface free of the liquid-absorbent resin 4 comes into contact with the heating blocks 103. Accordingly, the liquid-absorbent resin 4 is prevented from adhering to the heating blocks 103. Hence, there is no need for a step of cleaning the heating blocks 103.

Note that even in the configuration in which the liquid-absorbent resin 4 is held between portions of the substrate 5, the substrates 5 can be bonded together with an adhesive force generated by swelling of the liquid-absorbent resin 4, as with the above-described liquid absorber of the first modified example. This is because the liquid-absorbent resin 4 is exposed on a side surface of each of the substrates 5.

3.3. Third Modified Example

Figure 13:
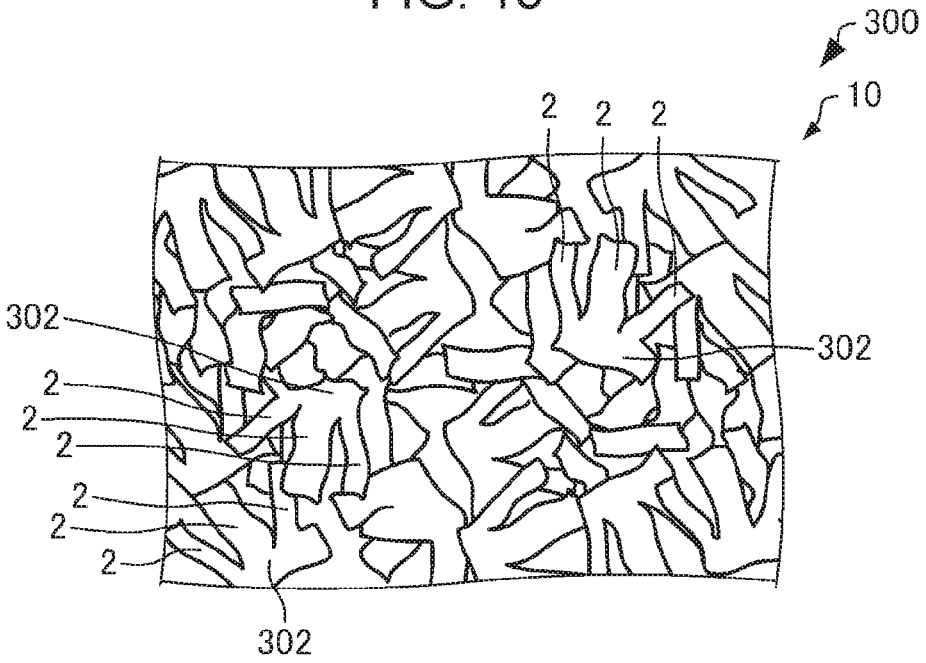
FIG. 13 is a diagram illustrating a liquid absorption member, which is loaded in a liquid absorber, according to a third modified example of an embodiment.

A liquid absorber according to a third modified example of an embodiment will now be described with reference to the drawings. FIG. 13 is a diagram illustrating an assembly of small pieces 2 included in a liquid absorber 300, according to the third modified example of the embodiment.

As illustrated in FIG. 13, the liquid absorber 300 is different from the above-described liquid absorber 100 in that a plurality of the small pieces 2 are coupled together with a coupling piece 302. With this configuration, in the process of storing the small pieces 2 in the body 32 of the case 320, the coupling piece 302 can be grasped, thereby collectively storing the plurality of the small pieces 2 in the body 32. Hence, the operation of storing the small pieces 2 can be carried out readily and quickly. Note that it is preferable that, as with the small pieces 2, the coupling piece 302 include the liquid-absorbent resin 4 supported thereon.

The plurality of small pieces 2 and the coupling piece 302 that couple together the plurality of small pieces 2 can be formed by, for example, making a plurality of parallel cuts in a sheet of paper such that the cuts extend from a first end of the sheet toward a second end of the sheet but do not reach the second end.

Note that the coupling piece 302 may be formed of a different member, examples of which include paper tape, staples, and other bonding members. Furthermore, in the illustrated example, the number of small pieces 2 that are coupled together via the coupling piece 302 is not particularly limited. Furthermore, the coupling piece 302 may not necessarily couple together the end portions of second ends of small pieces 2. For example, the coupling piece 302 may couple together middle portions of small pieces 2 with respect to longitudinal directions thereof.

4. Liquid Ejection Apparatus

Figure 14:
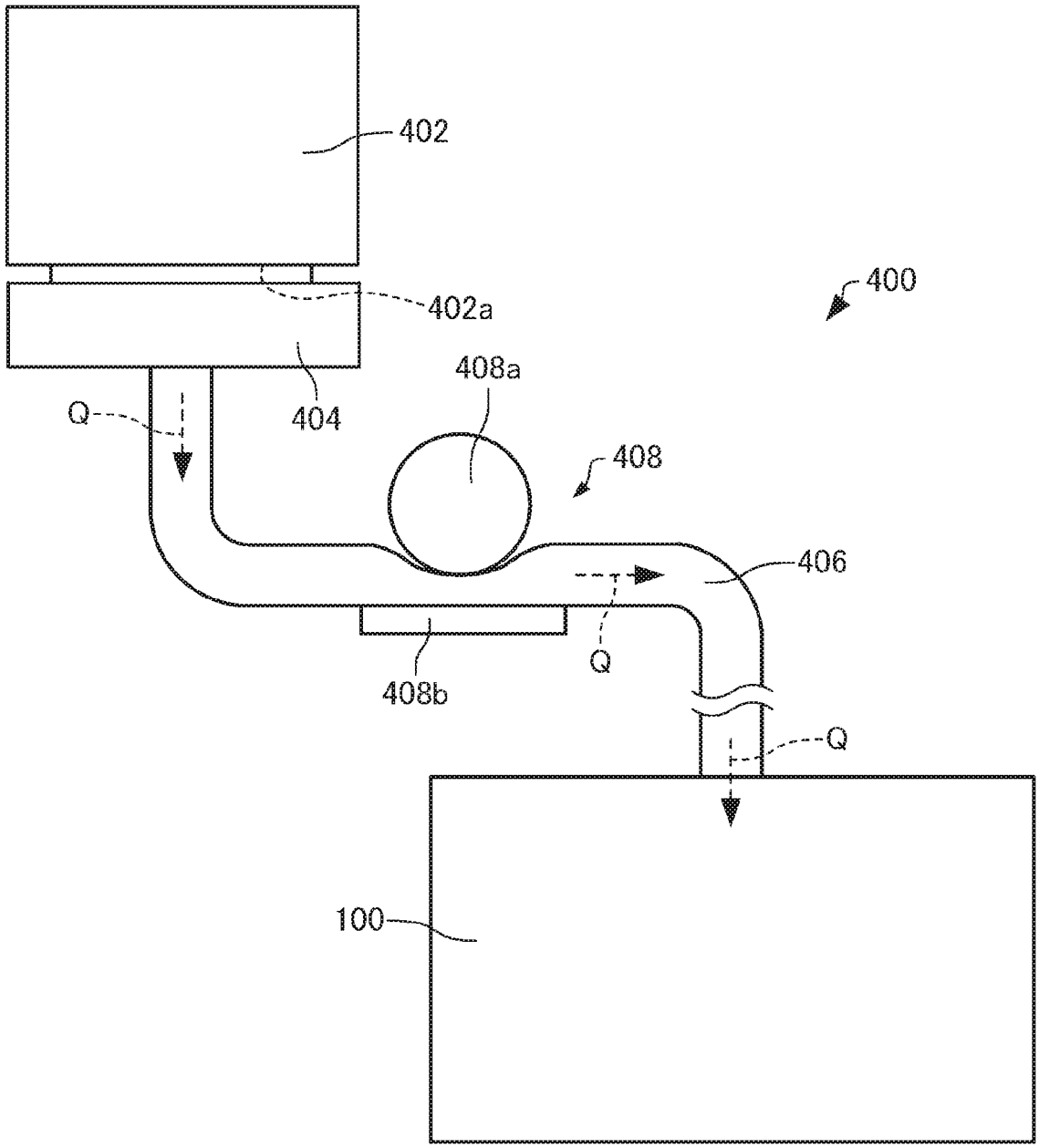
FIG. 14 is a schematic diagram illustrating a liquid ejection apparatus, according to an embodiment.

A liquid ejection apparatus according to an embodiment will now be described with reference to the drawings. FIG. 14 is a schematic diagram illustrating a liquid ejection apparatus 400, according to an embodiment.

As illustrated in FIG. 14, the liquid ejection apparatus 400 includes, for example, a liquid ejection head 402, a capping unit 404, the tube 406, a roller pump 408, and the liquid absorber 100. The liquid ejection head 402 ejects an ink Q. The capping unit 404 prevents clogging of nozzles 402*a* of the liquid ejection head 402. The tube 406 couples the capping unit 404 to the liquid absorber 100. The roller pump 408 delivers the ink Q from the capping unit 404. The liquid absorber 100 collects waste liquid of the ink Q.

The liquid ejection head 402 includes nozzles 402*a*, through which the ink Q is ejected downwardly. The liquid ejection head 402 can perform printing on a recording medium (not illustrated), such as a plain paper copier (PPC) sheet, by moving relative to the recording medium and ejecting the ink Q onto the recording medium.

The capping unit 404 prevents clogging of the nozzles 402*a* in a manner such that when the liquid ejection head 402 is in standby position, the roller pump 408 is actuated to cause the capping unit 404 to apply suction collectively to the nozzles 402*a*.

The tube 406 allows the ink Q, which is sucked through the capping unit 404, to pass through the tube 406 to the liquid absorber 100. The tube 406 may have flexibility, for example.

The roller pump 408 is located at a portion along the tube 406. The roller pump 408 includes a roller member 408*a* and a holder member 408*b*, which holds the portion of the tube 406 with the roller member 408*a*. Rotation of the roller member 408*a* generates a suction force in the capping unit 404 via the tube 406. Further, continuous rotation of the roller member 408*a* enables the ink Q adhering to the nozzles 402*a* to be delivered to the liquid absorber 100. The ink Q is delivered to the liquid absorber 100 and absorbed as a waste liquid.

The liquid absorber 100 is attachably and detachably mounted to the liquid ejection apparatus 400. In a state in which the liquid absorber 100 is mounted to the liquid ejection apparatus 400, the liquid absorber 100 absorbs the ink Q, which is ejected from the liquid ejection head 402. The liquid absorber 100 is a so-called waste liquid tank. When the amount of absorbed ink Q in the liquid absorber 100 has reached a limit, the liquid absorber 100 can be replaced with a new, unused liquid absorber 100.

Note that whether the amount of absorbed ink Q in the liquid absorber 100 has reached a limit may be detected by a detector (not illustrated) of the liquid ejection apparatus 400. Furthermore, when the amount of absorbed ink Q in the liquid absorber 100 has reached a limit, a notification of the fact may be made by a built-in notification unit of the liquid ejection apparatus 400, such as a monitor.

In present disclosure, one or more elements may be omitted, and various embodiments and/or modified examples may be combined together, as long as the features and effects described in the present application are retained.

The present disclosure is not limited to the embodiments described above, and various other modifications may be made. For example, the present disclosure includes configurations substantially identical with the configurations described in the embodiments. "Substantially identical configurations" are, for example, configurations in which functions, methods, and results are identical or configurations in which objects and effects are identical. Furthermore, the present disclosure includes configurations in which one or more non-essential elements of the configurations described in the embodiments are replaced with different elements. Furthermore, the present disclosure includes configurations that produce an effect identical with that of the configurations described in the embodiments or configurations that make it possible to achieve an object identical with that of the configurations. Furthermore, the present disclosure includes configurations in which one or more elements of the known art are added to any of the configurations described in the embodiments.

What is claimed is:

1. A liquid absorber comprising:
a liquid absorption member that absorbs liquid, the liquid absorption member including materials that include a fiber and a liquid-absorbent resin; and
a case in which the liquid absorption member is stored, the case having an opening portion, wherein
the materials of the liquid absorption member are bonded together in the at least a portion of a surface of the liquid absorption member with a bonding force of a water-soluble resin, the surface being a surface adjacent to the opening portion.

2. The liquid absorber according to claim 1, wherein the materials of the liquid absorption member are bonded to a sidewall portion of the case with the water-soluble resin.

3. The liquid absorber according to claim 1, wherein the liquid absorption member includes a first recessed portion disposed in a location corresponding to the opening portion.

4. The liquid absorber according to claim 1, wherein
the liquid absorption member includes an assembly of small pieces, and
each of the small pieces includes a substrate and the liquid-absorbent resin, the substrate including the fiber, the liquid-absorbent resin being supported by the substrate.

5. The liquid absorber according to claim 4, wherein the liquid-absorbent resin is held between a pair of portions of the substrate.

6. The liquid absorber according to claim 1, wherein
the liquid absorption member includes a second recessed portion, and
a porous liquid absorption member that absorbs the liquid is disposed in the second recessed portion, a portion of the porous liquid absorption member projecting from the liquid absorption member.

7. A liquid ejection apparatus comprising:
a liquid ejection head; and
the liquid absorber according to claim 1, the liquid absorber being configured to absorb the liquid, the liquid being ejected from the liquid ejection head.

8. A liquid absorber comprising:
a liquid absorption member that absorbs liquid, the liquid absorption member including materials that include a fiber and a liquid-absorbent resin; and
a case in which the liquid absorption member is stored, the case having an opening portion, wherein
the materials of the liquid absorption member are bonded together in the at least a portion of a surface of the liquid absorption member with an adhesive force generated by swelling of the liquid-absorbent resin, the surface being a surface adjacent to the opening portion.

9. The liquid absorber according to claim 8, wherein the materials of the liquid absorption member are bonded to a sidewall portion of the case with an adhesive force generated by swelling of the liquid-absorbent resin.

10. The liquid absorber according to claim 8, wherein the liquid absorption member is bonded to at least one of a sidewall portion of the case and a bottom portion of the case, the sidewall portion not being exposed to the surface.

* * * * *